US009509042B1

(12) United States Patent
Zheng et al.

(10) Patent No.: US 9,509,042 B1
(45) Date of Patent: Nov. 29, 2016

(54) SINGLE FEED PASSIVE ANTENNA FOR A METAL BACK COVER

(71) Applicant: Amazon Technologies, Inc., Seattle, WA (US)

(72) Inventors: Ming Zheng, Cupertino, CA (US); Adrian Napoles, Cupertino, CA (US); Jerry Kuo, San Jose, CA (US); Khaled Obeidat, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/819,412

(22) Filed: Aug. 5, 2015

(51) Int. Cl.
*H01Q 1/24* (2006.01)
*H01Q 1/48* (2006.01)
*H01Q 5/307* (2015.01)

(52) U.S. Cl.
CPC ..... *H01Q 1/243* (2013.01); *H01Q 1/48* (2013.01); *H01Q 5/307* (2015.01)

(58) Field of Classification Search
CPC ..... H01Q 1/243; H01Q 1/48; H01Q 5/307
USPC ..... 343/702, 872, 846, 848, 700 MS
See application file for complete search history.

(56) References Cited

U.S. PATENT DOCUMENTS

2011/0001673 A1* 1/2011 You ..... H01Q 1/243 343/702
2012/0112969 A1* 5/2012 Caballero ..... H01Q 1/243 343/702
2012/0299785 A1* 11/2012 Bevelacqua ..... H01Q 9/42 343/702
2013/0169490 A1* 7/2013 Pascolini ..... H01Q 5/357 343/702
2014/0266922 A1* 9/2014 Jin ..... H01Q 21/28 343/702

FOREIGN PATENT DOCUMENTS

CN 102394354 A 3/2012
WO 2013107921 A1 7/2013

* cited by examiner

*Primary Examiner* — Hoanganh Le
(74) *Attorney, Agent, or Firm* — Lowenstein Sandler LLP

(57) ABSTRACT

Antenna structures and methods of operating the same are described. One apparatus includes a metal cover having a first corner ground element, a second corner ground element, a first strip element, a second strip element, a radio frequency (RF) feed, and a RF circuit. The first strip element is physically separated from the first corner ground element by a first cutout in the metal cover. The first strip element is physically separated from the second strip element by a second cutout in the metal cover. The second strip element is physically separated from the second corner ground element by a third cutout in the metal cover. The RF circuitry is coupled to the RF feed, where the RF circuitry is operable to cause the first corner ground element and the first strip element as well as the second corner ground element and the second strip element to radiate electromagnetic energy.

20 Claims, 9 Drawing Sheets

SINGLE FEED PASSIVE ANTENNA FOR A METAL BACK COVER

BACKGROUND

A large and growing population of users is enjoying entertainment through the consumption of digital media items, such as music, movies, images, electronic books, and so on. The users employ various electronic devices to consume such media items. Among these electronic devices are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
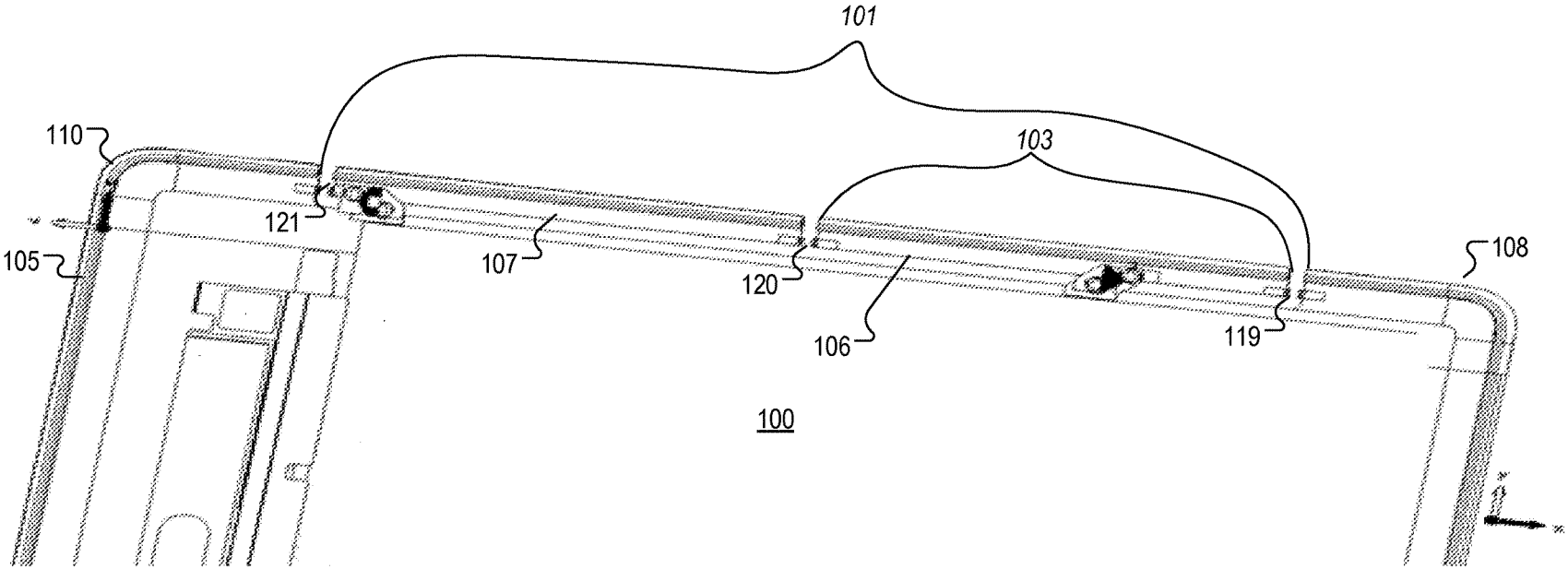
FIG. 1A is a diagram of an antenna architecture of an electronic device with a low-band structure and a high-band structure according to one embodiment.

Electronic devices traditionally use conventional antennas that may be externally mounted to the electronic devices (e.g., external antennas) to avoid interference from internal components of the electronic devices and housings of the electronic devices. As electronic devices continue to be miniaturized, antennas may be integrated within the electronic devices to increase functionality and aesthetic design of the electronic devices.

With the integration of antennas into electronic devices, a material of a housing of an electronic device can play an increasing role in a level of interference generated by the electronic device for the integrated antenna when the electronic device communicates data. For example, to provide durability and ruggedness, the electronic device can have a primarily metal housing. However, the metal housing may reflect electromagnetic waves communicated between the integrated antenna and other antennas external to the electronic device. The reflection of the electromagnetic waves can interfere with the integrated antenna transmitting and receiving signals. A traditional mobile device with a metal back cover typically require windows nearby the corners of the metal back cover or active components (e.g., tunable components) to use the integrated antennas for communication. Additionally, the traditional integrated antennas may not have sufficient bandwidth to meet a bandwidth demand for services used by the electronic device.

The embodiments described herein may address the above noted deficiencies by an electronic device employing an antenna structure that utilizes a metal cover of the electronic device, such as back cover. The electronic device may be any content rendering device that includes a modem for connecting the electronic device to a network. Examples of such electronic devices include electronic book readers, portable digital assistants, mobile phones, laptop computers, portable media players, tablet computers, cameras, video cameras, netbooks, notebooks, desktop computers, gaming consoles, Blu-ray® or DVD players, media centers, drones, speech-based personal data assistants, and the like. The electronic device may connect to a network to obtain content from a server computing system (e.g., an item providing system) or to perform other activities. The electronic device may connect to one or more different types of cellular networks.

The antenna structure herein can utilize portions of the metal cover (e.g., strip elements) as low band and high band radiators, respectively without windows nearby the corners as done conventionally. The antenna structure herein can also utilize internal coupling elements and passive reactive loading (e.g., inductors and capacitors) for tuning. An advantage of preserving the corners of the metal cover can be to enhance the durability and reliability of the electronic device.

The antenna structure can have a unique loop grounding structure, as described in more detail herein. The grounding structure utilizes corner ground elements to cause a loop current that fully loops around the metal cover described and illustrated herein. The antenna structure can communicate at a low frequency band and at a high frequency band using strip elements as described and illustrated herein. The embodiments described herein utilize the strip elements to give effective radiation and provide bandwidth without active or tunable matching components.

The embodiments described herein can also utilize the strip elements of the antenna structure as a proximity sensor. The strip elements can be considered capacitors of which the capacitance can be measured by proximity sensing circuit. An advantage of the electronic device using the strip elements as part of the antenna structure and as part of the proximity sensor can be to integrate the antenna structure and the proximity sensor into the same structure of the electronic device.

Several topologies of antenna structures are contemplated herein. The antenna structures described herein can be used for wireless area network (WAN) technologies, such as cellular technologies including Long Term Evolution (LTE) frequency bands, third generation (3G) frequency bands, Wi-Fi® and Bluetooth® frequency bands or other wireless local area network (WLAN) frequency bands, global navigation satellite system (GNSS) frequency bands (e.g., positioning system (GPS) frequency bands), and so forth.

FIG. 1A is a diagram of an antenna architecture of an electronic device 100 with a low-band structure 101 and a high-band structure 103 according to one embodiment. The electronic device 100 can include a metal cover 105. One corner of the metal cover 105 is a first corner ground element 108 disposed at a periphery of the metal cover 105. Another corner of the metal cover 105 is a second corner ground element 110 disposed at a periphery of the metal cover 105.

The low-band structure 101 includes a first strip element 106, a second strip element 107, the first corner ground element 108, and the second corner ground element 110. The first strip element 106 is physically separated from the first corner ground element 108 by a first cutout 119 in the metal cover 105. The first strip element 106 is also physically separated from the second strip element 107 by a second cutout 120 in the metal cover 105. The second strip element 107 is physically separated from the second corner ground element 110 by a third cutout 121 in the metal cover 105. The first strip element 106 and the second strip element 107 of the low-band structure 101 can resonate as a dipole antenna at a low band. The high-band structure 103 includes the first strip element 106 and the first corner ground element 108. The first strip element 106 of the high-band structure 103 can resonate as a dipole antenna at a high band.

The first strip element 106 and the second strip element 107 are disposed at the periphery of the metal cover 105. In one embodiment, the first cutout 119, the second cutout 120, and the third cutout 121 can each measure 1.8 millimeters (mm) in width. In another embodiment, the first cutout 119, the second cutout 120, and the third cutout 121 can each measure 2.0 mm in width. Alternatively, other widths may be used.

In one embodiment, the first cutout 119, the second cutout 120, and the third cutout 121 are disposed at symmetric locations on a first side of the electronic device 100 relative to a center point on the first side of the electronic device. For example, the second cutout 120 can be located at a center point along a top edge of the metal cover 105. In this example, the first cutout 119 and the third cutout 121 can be at equidistance locations from the second cutout 120. In another embodiment, the first cutout 119, the second cutout 120, and the third cutout 121 are disposed at non-symmetric locations along first side of the electronic device 100, such as the top edge of the metal cover 105.

Figure 1C:
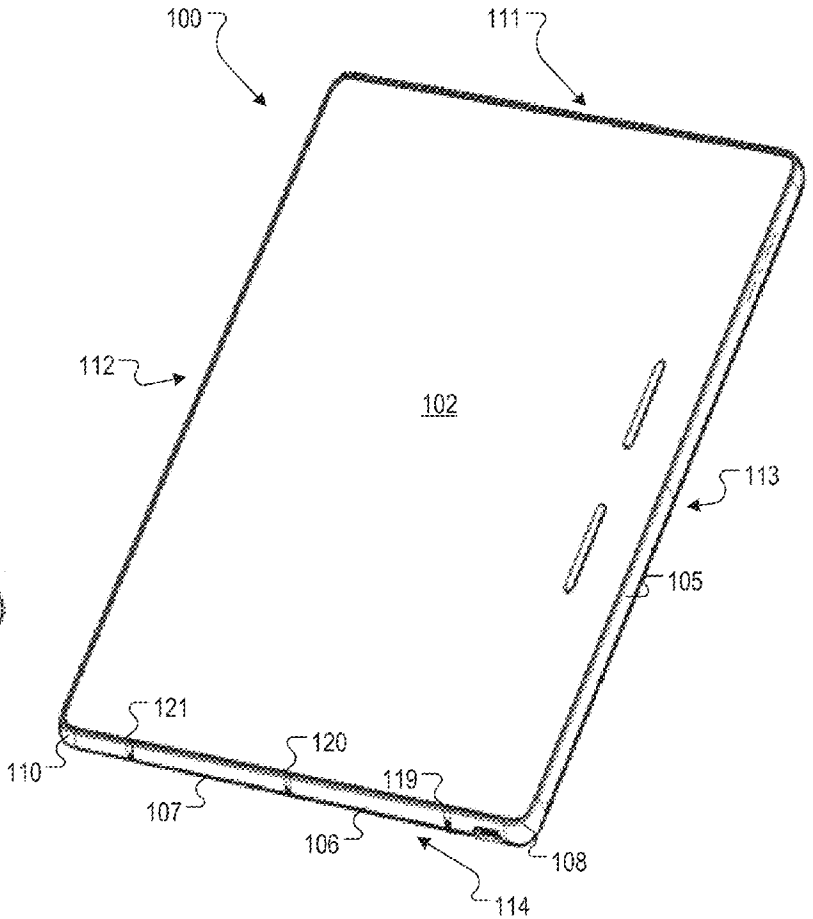
FIG. 1C shows a front view of the electronic device according to one embodiment.
Figure 1B:
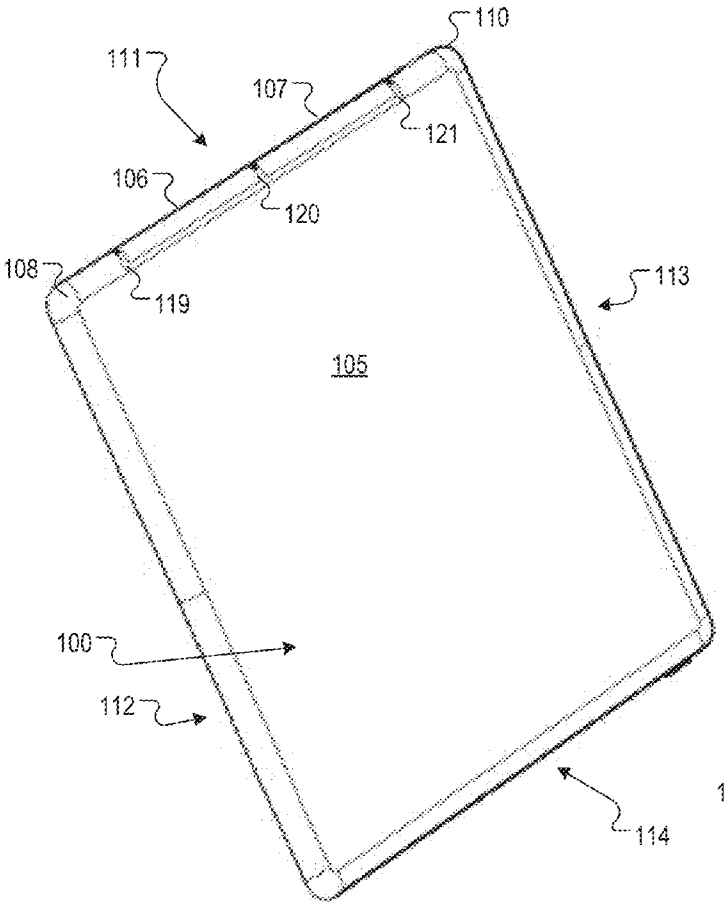
FIG. 1B shows a back view of the electronic device according to one embodiment.

FIG. 1B shows a rear view of the electronic device 100 according to one embodiment. The electronic device 100 can include the metal housing or metal cover 105 to house electronic components of the device, such as components for a table computing device. The metal cover 105 can have multiple edges, such as a top edge 111, a bottom edge 114, a first side edge 112, and a second side edge 113. In one example, the top edge 111, the bottom edge 114, the first side edge 112, or the second side edge 113 of the metal cover 105 may be curved or rounded. In another example, the top edge 111, the bottom edge 114, the first side edge 112, or the second side edge 113 of the metal cover 105 may be squared or straight.

In one example, the first strip element 106, the second strip element 107, the first corner ground element 108, the second corner ground element 110, the first cutout 119, the second cutout 120, and the third cutout 121 can be located along one of the top edge 111, the bottom edge 114, the first side edge 112, or the second side edge 113. In one example, the first strip element 106 and the second strip element can be the same length. For example, the first strip element 106 and the second strip element can each be 44 mm. In another example, the first strip element 106 and the second strip element can be different lengths. For example, the first strip element 106 can be 42 mm and the second strip element can be 46 mm. In another example, the first strip element 106 and the second strip element can be disposed at symmetric locations on the top edge 111 of the electronic device 100 relative to a center point of the top edge 111. The length and location of the first strip element 106 and the second strip element can vary and the preceding embodiments and examples are exemplary and not intended to be limiting.

In one embodiment, the first corner ground element 108 can be a first L-shape that starts at the first side edge 112 of the metal cover 105 and bends to the top edge 111 of the electronic device 100 (e.g., bends around a first corner of the electronic device 100 to the top edge 111). In another embodiment, the second corner ground element 110 can be a second L-shape that starts at the second side edge 113 of the metal cover 105 and bends to the top side or edge 111 (e.g., bends around a second corner of the electronic device 100 to the top edge 111). In one example, the first corner ground element 108 and the second corner ground element 110 can be separate parts. In another example, the first corner ground element 108 and the second corner ground element 110 can be integrated with the rest of the metal cover 105. The location of the first corner ground element 108 and the second corner ground element 110 can vary and the preceding embodiments and examples are exemplary and not intended to be limiting.

FIG. 1C shows a front view of the electronic device 100 according to one embodiment. The electronic device 100 can include the metal cover 105 to house electronic components of the device, such as components for a tablet computing device and a display 102. The metal cover 105 can the top edge 111, the bottom edge 114, the first side edge 112, and the second side edge 113 that surround the display 102. In one example, the first strip element 106, the second strip element 107, the first corner ground element 108, the second corner ground element 110, the first cutout 119, the second cutout 120, and the third cutout 121 can be located along the top edge 111, the bottom edge 114, the first side edge 112, or the second side edge 113.

Figure 2A:
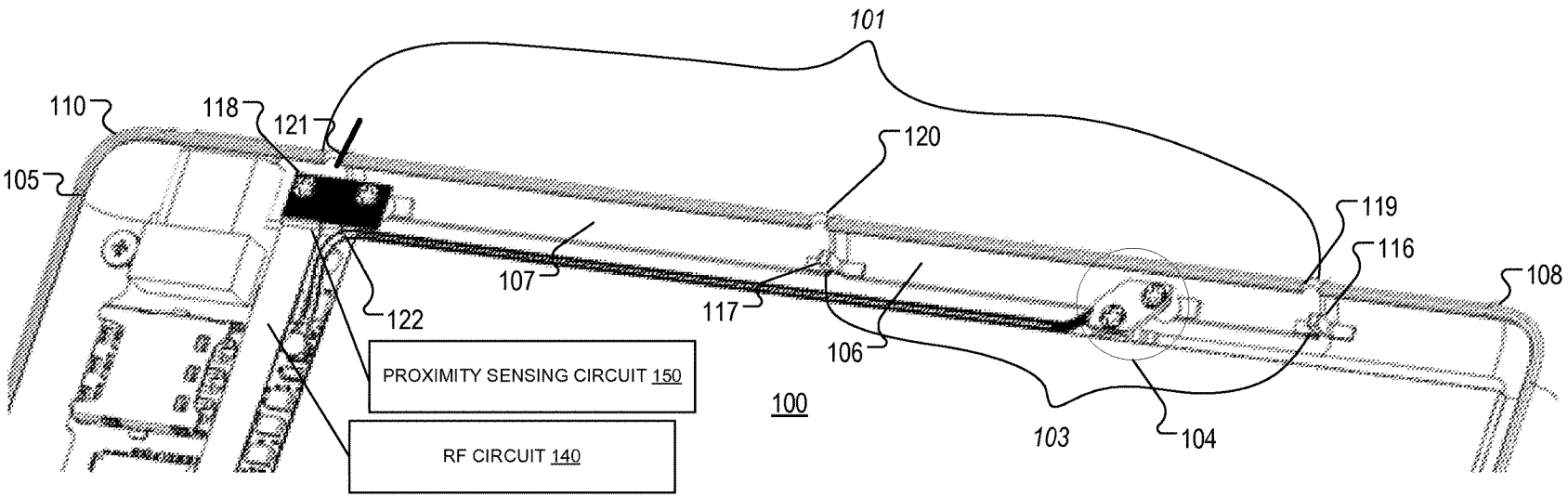
FIG. 2A is a diagram of an antenna architecture of an electronic device with the low-band structure and the high-band structure connected to the metal cover by capacitors according to one embodiment.

FIG. 2A is a diagram of an antenna architecture of an electronic device 100 with the low-band structure 101 and the high-band structure 103 connected to the metal cover 105 by capacitors 116 and 117 and by a lumped capacitor 118 according to one embodiment. The capacitor 116 is disposed between the first corner ground element 108 and the first strip element 106. The capacitor 117 is disposed between the first strip element 106 and the second strip element 107. In one example, the capacitors 116 and 117 can be small capacitors (such as 10 pico-farad (pf) capacitors) that may be suitable at very low frequency to work as proximity sensor pad, as described herein. The lumped capacitor 118 is disposed between the second strip element 107 and a second corner ground element 110. A conductive path can be between a first connection coupled to the second strip element 107 and a second connection coupled to the second corner ground element 110. The capacitor 116 can be adjusted to change an electrical length of the first strip element, which resonates at the high band. The capacitor 117 can be adjusted to change the bandwidth of low band and high band.

The first strip element 106 can be connected between the first corner ground element 108 and the second strip element 107 and the second strip element 107 can be connected to the second corner ground element 110 to form the low-band structure 101. The low-band structure 101 is a resonance structure that resonates in a first frequency range (e.g., a low band). The first corner ground element 108 can be connected to the first strip element 106 to form the high-band structure 103. The high-band structure 103 is a resonance structure that resonates in a second frequency range (e.g., a high band).

The electronic device 100 can include a RF circuitry 140 (also referred to herein as RF chipset and RF circuit), a feed line 122, and a feed point 104. The first strip element 106 and the second strip element 107 can operate as part of the metal cover 105 in a structural manner. The first strip element 106 and the second strip element 107 can also be operational in a first mode of the electronic device 100, as well as in a second mode of the electronic device 100. In one example, the first mode can be an antenna mode where the antenna architecture can radiate as an antenna. In another example, the second mode can be a proximity sensing mode where the antenna architecture can determine a proximity of an object. In particular, first strip element 106 and the second strip element 107 can operate as an electrode of a proximity sensing circuitry 150. A capacitance of the electrode can be measured by the proximity sensing circuitry 150.

The proximity sensing circuitry 150 can be coupled to a lumped capacitor 118. The lumped capacitor 118 can include reactive loads, such as lumped chip capacitors or lumped chip inductors. In one example, the lumped capacitor 118 can include a chip capacitor in series with a chip inductor. The lumped capacitor 118 can decrease an electrical length of the second strip element 107. A series reactive impedance (e.g., a combination of the chip capacitor and the chip inductor) can increase or decrease the low band resonance frequency.

A switch can control the coupling of the RF circuitry 140 and the proximity sensing circuitry 150 to the lumped capacitor 118. Alternatively, matching components (as discussed in FIG. 2C) can be used to permit both the proximity sensing circuitry 150 and the RF circuitry 140 to be coupled to the first strip element 106 via the feed point. As discussed in the proceeding paragraphs, the matching components can move an impedance of the antenna on Smith chart to around the center of the smith chart.

Figure 2B:
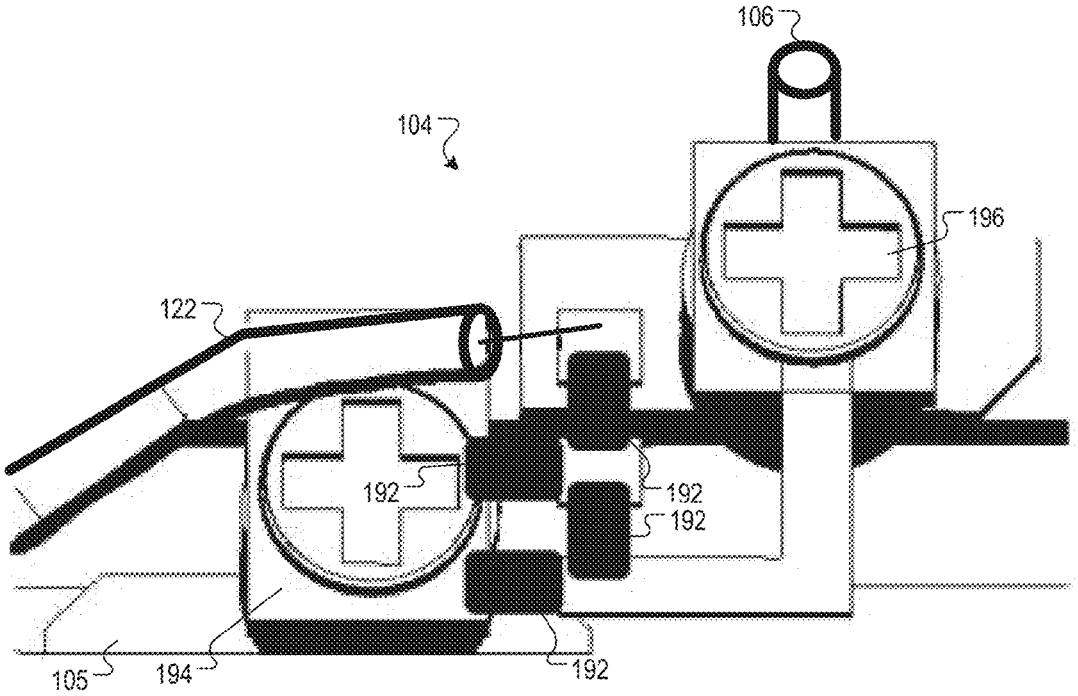
FIG. 2B shows an expanded view of the feed point according to one embodiment.

FIG. 2B shows an expanded view of the feed point 104 according to one embodiment. The feed point 104 can couple the first strip element 106 to the metal cover 105. In one example, resistors, inductors, and/or capacitors 192 (referred to herein as RLC components) can connect a first section or connector 194 of the metal cover 105 and with a second section or connector 196 of the first strip element 106. The second connector 196 can also connect to the feed line 122. The feed line 122 is coupled to the RF circuitry 140 (as in FIG. 2A).

Figure 2C:
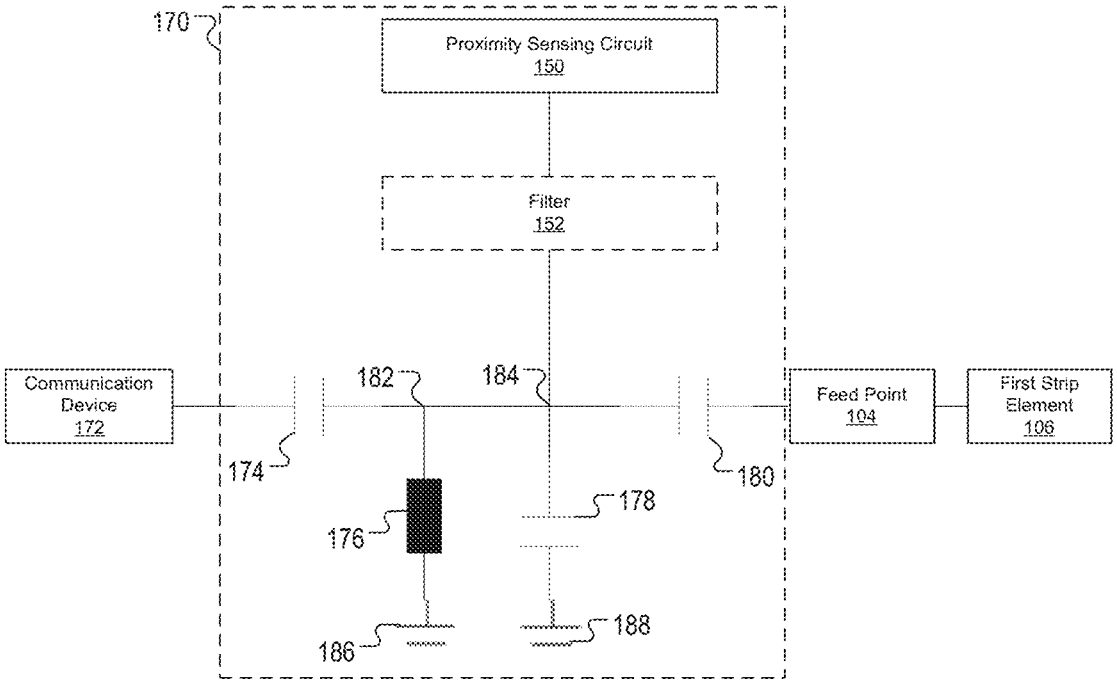
FIG. 2C is a schematic diagram of an impedance matching circuitry according to one embodiment.

FIG. 2C is a schematic diagram of an impedance matching circuitry 170 according to one embodiment. In this embodiment, the impedance matching circuitry 170 is disposed in-line with the feed point 104 and the low-band structure 101. The impedance matching circuitry 170 can also be disposed before the feed point 104 on the circuit board where the RF circuitry 140 resides. The impedance matching circuitry 170 can include a proximity sensing circuitry 150 coupled to the filter 152. The filter 152 can be coupled between the proximity sensing circuitry 150 and a second intermediate node 184. In this embodiment, the impedance matching circuitry 170 includes two series capacitors 174, 178, 180 and a shunt inductor 176. The first series capacitor 174 is coupled between a communication device 172 and a first intermediate node 182. In one example, the communication device 172 can be a WAN device, a modem, or other antenna circuitry.

The shunt inductor 176 is coupled between the first intermediate node 182 and a first ground 186. The second series capacitor 178 is coupled between the second intermediate node 184 and a second ground 188. The third series capacitor 180 is coupled between the second intermediate node 184 and the feed point 104. The first strip element 106 is coupled to the feed point 104. In one embodiment, the impedance matching circuitry 170 may be disposed on a printed circuit board (PCB). In the depicted embodiment, the impedance matching circuitry 170 can be a simple matching T circuitry and can be used to further enlarge the bandwidth of the antenna structure. Alternatively, other components and other configurations of components may be used for matching the low-band structure 101 or the high-band structure 103 in other ways.

In some embodiments, a proximity sensing circuitry 150 can be coupled to the low-band structure 101 via the filter 152. In one example, the filter 152 can be a low-pass filter. In another example, the filter 152 can be an inductor. Alternatively, the proximity sensing circuitry 150 can be coupled to the low-band structure 101 without the filter 152. The filter 152 may operate to filter signals from the RF circuitry 140 driven at the feed point 104. Alternatively, other configurations of the RF circuitry 140 and proximity sensing circuitry 150 may be utilized for the low-band structure 101 and the high-band structure 103. In one embodiment, the low-band structure 101 can be switched between an antenna mode and a proximity sensing mode. In another embodiment, the low-band structure 101 can operate concurrently in the antenna mode and the proximity sensing mode because the proximity sensing mode operates at a lower frequency than the antenna mode. In another example, the low-band structure 101 and the high-band structure 103 can operate at the same time at different frequency bands (e.g., a low frequency band and a high frequency band). The low-band structure 101 and the high-band structure 103 can be tuned using internal coupling elements (e.g., the capacitors 116 and 117) in addition to passive reactive loading (e.g., the lumped capacitor 118).

Returning to FIG. 2A, the low-band structure 101 is made up of the ground plane of the metal cover 105, the feed point 104, the first strip element 106, the second strip element 107, the first corner ground element 108, the second corner ground element 110, and the capacitor 117. The low-band structure 101 with the capacitor 116 operates as a first radiator. The high-band structure 103 is made up of the ground plane of the metal cover 105, the first strip element 106, and the first corner ground element 108. The high-band structure 103 with the capacitor 116, the capacitor 117, and the lumped capacitor 118 operates as a second radiator.

In one embodiment, the capacitor 116 is disposed between the first strip element 106 and the first corner ground element 108 at a first distal end of the first strip element 106, near an end of the first corner ground element 108. The first corner ground element 108 is coupled to the ground plane. The capacitor 117 is disposed between the first strip element 106 and the second strip element 107 at a second distal end of the first strip element 106 and a first distal end of the second strip element. In this embodiment, the lumped capacitor 118 is disposed between the second strip element 107 and the second corner ground element 110. The second corner ground element 110 is coupled to the ground plane.

In one embodiment, the RF circuitry 140 includes the communication device 172 (illustrated in FIG. 2C). In one example, the communication device can be a WAN module. The WAN module is operable to cause the feed point 104, the first strip element 106, the second strip element 107, the first corner ground element 108, and the second corner ground element 110 to radiate electromagnetic energy in a first frequency range (such as approximately 0.7 GHz-1.0 GHz) in a first resonant mode and a second frequency (such as 1.7 GHz-2.1 GHz) in a second resonant mode. In another embodiment, the RF circuitry 140 may include other modules, such as a WLAN module, a personal area network (PAN) module, a GNSS module (e.g., a GPS module), and so forth.

The low-band structure 101 can be designed to be self-resonant at 800 MHz and 950 MHz. The high-band structure 103 can be designed to be self-resonant at 1.77 GHz and 1.93 GHz. The antenna architecture can be adjusted to match different bands. Alternatively, other resonant modes can be achieved, such as for WLAN frequency bands. For example, in dual-band Wi-Fi® networks, the low-band structure 101 and high-band structure 103 can be adjusted to cover the 2.4 GHz band and the 5 GHz band, respectively.

For example, the WLAN module may include a WLAN RF transceiver for communications on one or more Wi-Fi® bands (e.g., 2.4 GHz and 5 GHz). It should be noted that the Wi-Fi® technology is the industry name for wireless local area network communication technology related to the IEEE 802.11 family of wireless networking standards by Wi-Fi Alliance. For example, a dual-band WLAN RF transceiver allows an electronic device to exchange data or connection to the Internet wireless using radio waves in two WLAN bands (2.4 GHz band, 5 GHz band) via one or multiple antennas. For example, a dual-band WLAN RF transceiver includes a 5 GHz WLAN channel and a 2.4 GHz WLAN channel.

The antenna architecture may include additional RF modules and/or other communication modules, such as a WLAN module, a GPS receiver, a near field communication (NFC) module, an amplitude modulation (AM) radio receiver, a frequency modulation (FM) radio receiver, a PAN module (e.g., Bluetooth® module, Zigbee® module), a GNSS receiver, and so forth. The RF circuitry 140 may include one or multiple RF front-end (RFFE) circuitries (also referred to as RF circuit). The RFFEs may include receivers and/or transceivers, filters, amplifiers, mixers, switches, and/or other electrical components. The RF circuitry 140 may be coupled to a modem that allows the electronic device 100 to handle both voice and non-voice communications (such as communications for text messages, multimedia messages, media downloads, web browsing, etc.) with a wireless communication system. The modem may provide network connectivity using any type of digital mobile network technology including, for example, LTE, LTE advanced (4G), CDPD, GPRS, EDGE, UMTS, 1×RTT, EVDO, HSDPA, WLAN (e.g., Wi-Fi® network), etc. In the depicted embodiment, the modem can use the RF circuitry 140 to radiate electromagnetic energy on the antennas to communication data to and from the electronic device 100 in the respective frequency ranges. In other embodiments, the modem may communicate according to different communication types (e.g., WCDMA, GSM, LTE, CDMA, WiMAX, etc.) in different cellular networks.

Additional details regarding the current follow for the dual resonance are described below with respect to FIGS. 3, 4A, and 4B. The capacitors 116 and 117 and the lumped capacitor 118 can increase the radiation of the antenna structure by changing the current flow on the first strip element 106 to a loop current flowing from the feed point 104, through the first strip element 106 and the second strip element 107, and looping around the metal cover 105 back to the feed point 104. The capacitors 116 and 117 and the lumped capacitor 118 may be discrete components with a capacitive value or may be conductive traces with the corresponding capacitance value. In one embodiment, the capacitors 116 and 117 and the lumped capacitor 118 can have capacitance values of 2 pico-farads (pF). This type of capacitance value gives a very small loading effect when in the proximity sensing mode, but provides the looping current effect in the antenna mode as described herein.

In another embodiment, the electronic device 100 can include a switch coupled between the RF circuitry 140 and the feed point 104, where the switch can change the electronic device 100 between an antenna mode and a proximity sensing mode. The electronic device 100 further includes the proximity sensing circuitry 150 coupled to the switch. The proximity sensing circuitry 150 can be operable to measure a capacitance of the first strip element 106, the second strip element 107, or a combination thereof in the proximity sensing mode. In a further embodiment, the electronic device 100 can switch from the antenna mode to a proximity sensing mode and use the proximity sensing circuitry 150 to measure a capacitance of the first strip element 106, the second strip element 107, or a combination thereof to detect an object proximate to the first strip element 106, the second strip element 107.

The first strip element 106 and the second strip element 107 can be operable to radiate the electromagnetic energy as part of the antenna mode. In another embodiment, the electronic device does not switch between modes, but uses an inductor as an RF choke between the feed point 104 and the proximity sensing circuitry 150 as described herein. In one example, the proximity sensing circuitry 150 can feed in series with the RF choke. In another example, the RF choke can be 100 nano-henrys (nH).

Figure 3:
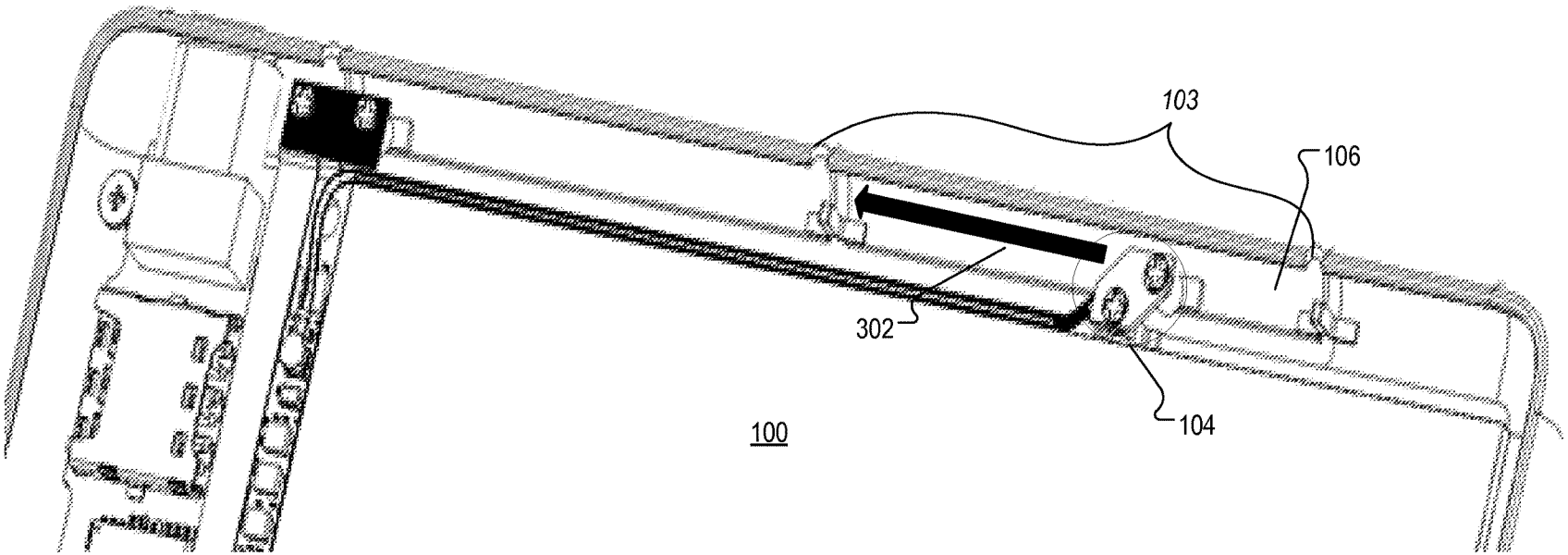
FIG. 3 illustrates a current flow of the high-band structure according to one embodiment.

FIG. 3 illustrates a current flow 302 of the high-band structure 103 according to one embodiment. The current flow 302 flows from the feed point 104 through the first strip element 106. In one example, the first strip element 106 can operate in a half wavelength dipole mode at a high band frequency, e.g., a resampling dipole mode in terms of a resonant wavelength.

Figure 4A:
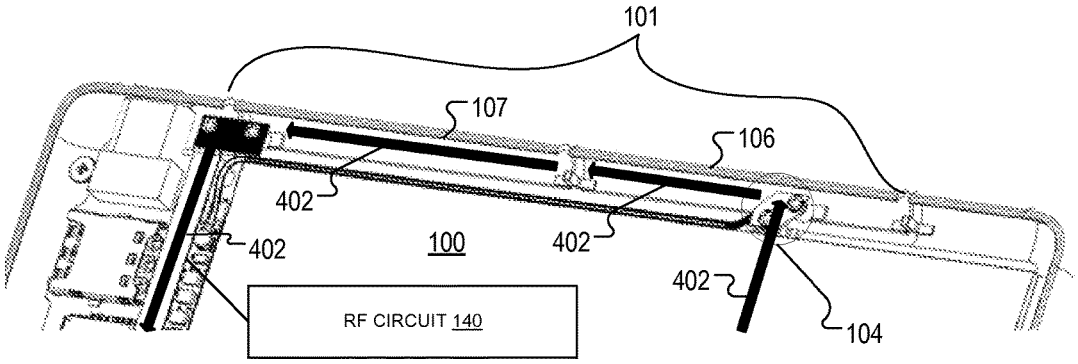
FIG. 4A illustrates current flow of the low-band structure according to one embodiment.

FIG. 4A illustrates looping current flow 402 of the low-band structure 101 according to one embodiment. The looping current flow 402 flows from the feed point 104, through the first strip element 106 and the second strip element 107, through the RF circuitry 140 and loops back to the feed point 104. In one embodiment, the first strip element 106 can be connected to a WAN module through the impedance matching circuitry 170. The first strip element 106 can be a second electrode for the proximity sensor. For example, the second pad can be used for coverage testing, where the electronic device 100 may need to meet a specific absorption rate (SAR) hotspot coverage test requirement of a regulator body.

Figure 4B:
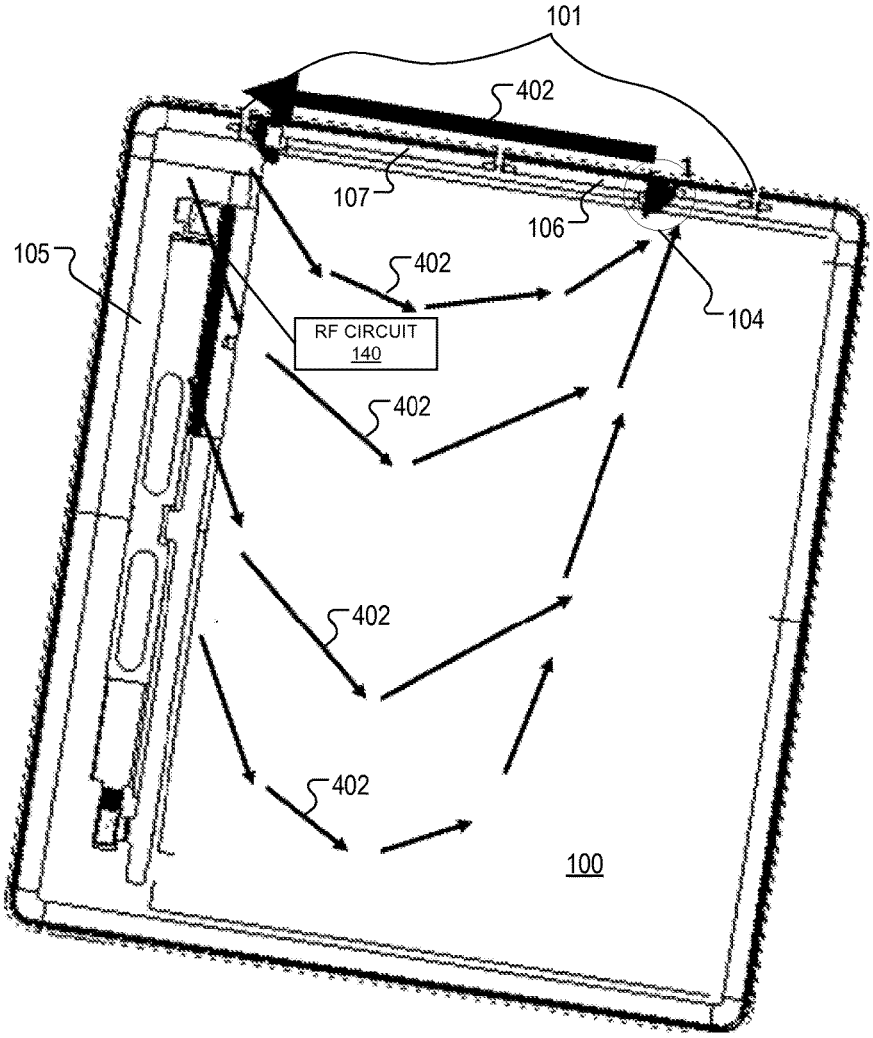
FIG. 4B illustrates looping current flows of the low-band structure according to one embodiment.

FIG. 4B illustrates a looping current flow 402 of the low-band structure 101 according to one embodiment. In FIG. 4B, the looping current flow 402 flows from the feed point 104, through the first strip element 106 and the second strip element 107 around the metal cover 105, and loops back to the feed point 104.

Figure 5:
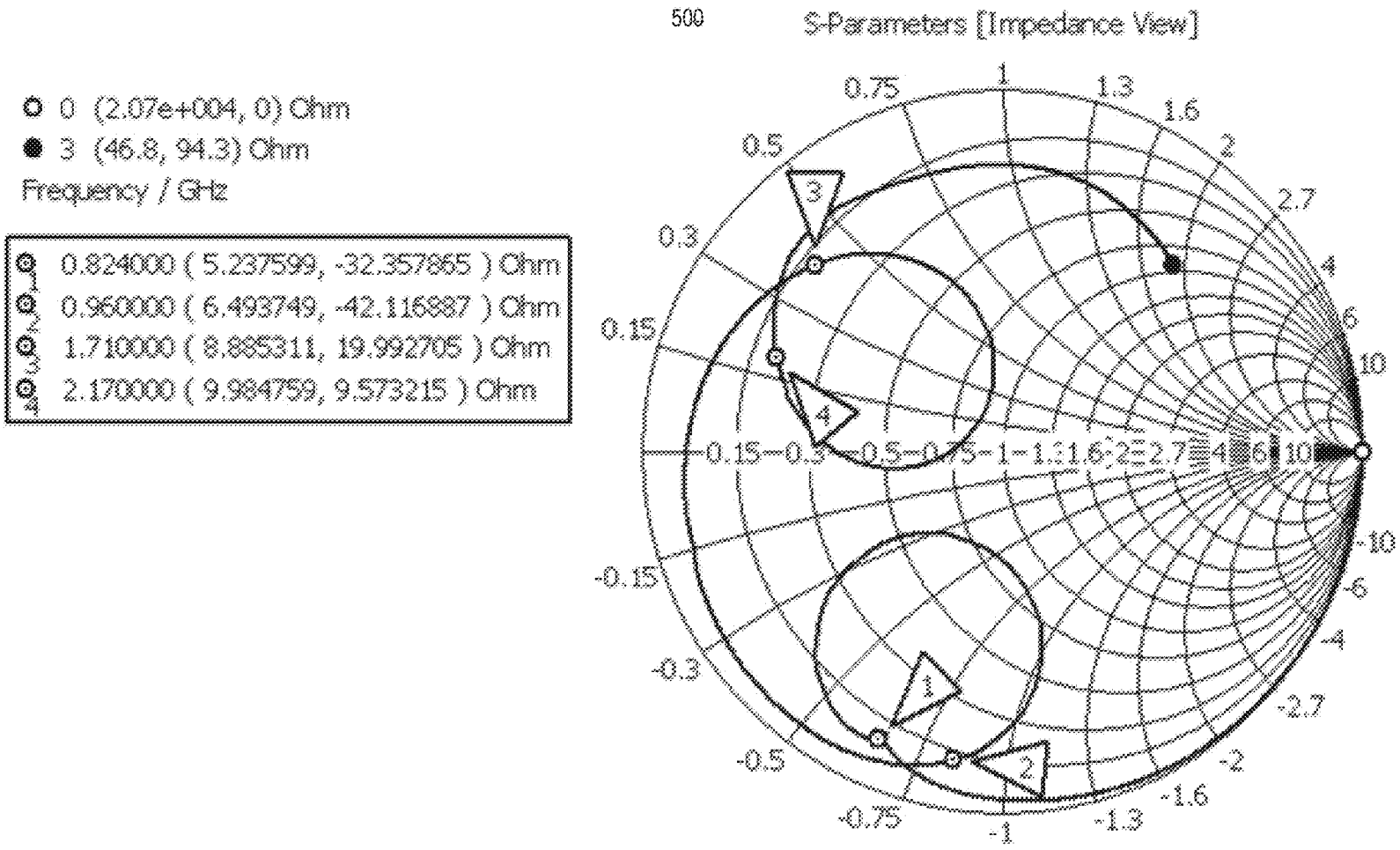
FIG. 5 is a Smith chart of an input impedance of the low-band structure and the high-band structure according to one embodiment.

FIG. 5 is a Smith chart 500 of an input impedance of the low-band structure 101 and the high-band structure 103 according to one embodiment. The Smith chart 500 illustrates how the impedance and reactance behave at one or more frequencies for the low-band structure 101 and at one or more frequencies for the high-band structure 103. Points 1 and 2 of the Smith chart 500 correspond to the impedance of the low-band structure 101 of FIG. 3 for a frequency range of approximately 0.824 GHz to 0.96 GHz. Points 3 and 4 of the Smith chart 500 correspond to the impedance of the high-band structure 103 of FIGS. 4A and 4B for a frequency range of approximately 1.71 GHz to 2.17 GHz. In one example, a coupling between the first strip element 106 and the second strip element 107 of the high-band structure 103 can create an efficient resonance with a potential wide bandwidth on the Smith chart 500 (e.g., a small loop locus on the Smith chart 500).

Figure 6:
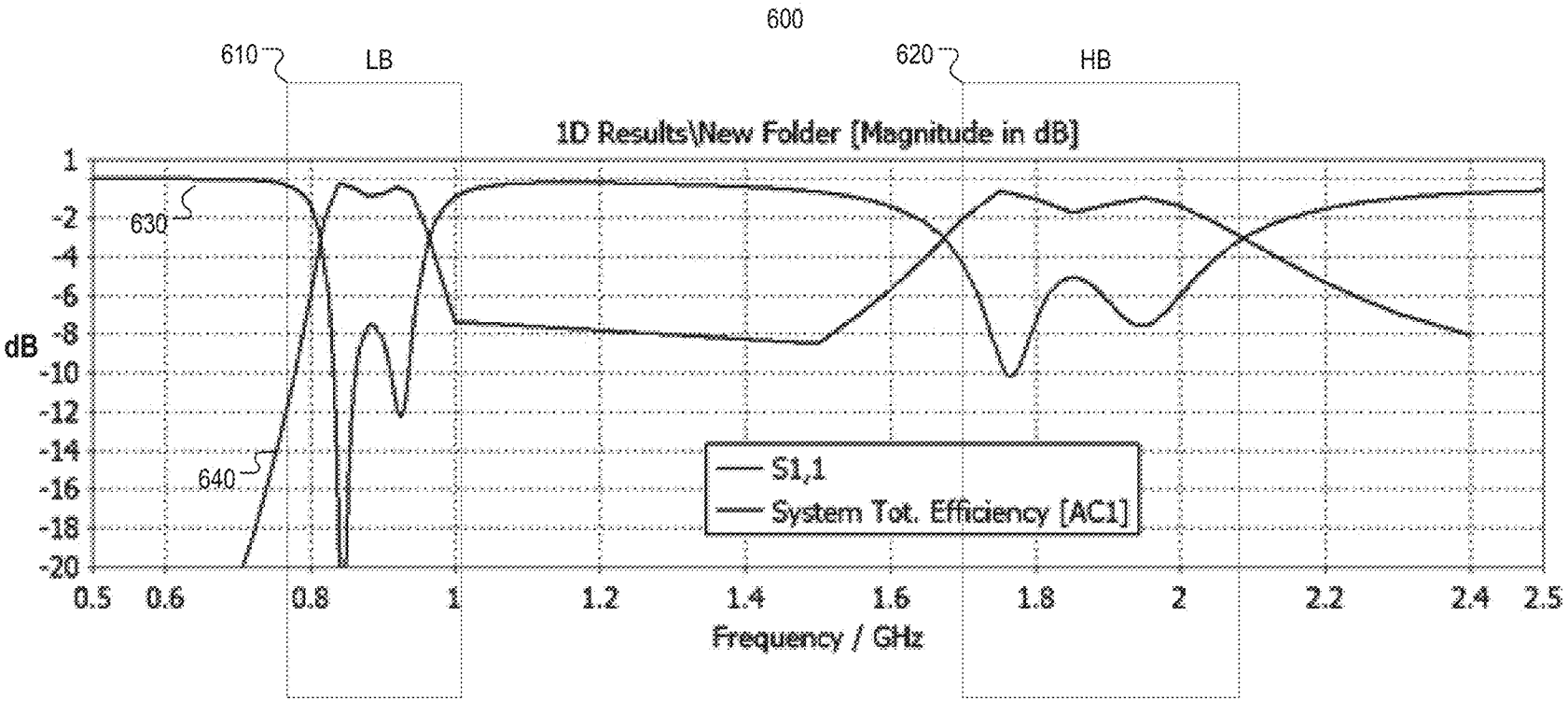
FIG. 6 is a graph of a $S_{11}$ parameter and a total system efficiency of an antenna structure according to one embodiment.

FIG. 6 is a graph 600 of the $S_{11}$ parameter 602 and a total system efficiency of the antenna structure of FIG. 1A according to one embodiment. The graph 600 shows the $S_{11}$ parameter 630 of the antenna structure in a low band (LB) 610 and in a high band (HB) 620. The $S_{11}$ parameter 630 is measured in decibels (dB). In one embodiment, the LB 610 covers a frequency range between approximately 770 MHz and approximately 1.0 GHz, such as for GSM850/900 bands. Alternatively, other frequencies in the LB 610 may be covered by the low-band structure 101. In one embodiment, the HB 620 covers a frequency range between approximately 1.7 GHz and 2.1 GHz. Alternatively, other frequencies in the HB 620 may be covered by the high-band structure 103. The graph 600 shows the total system efficiency parameter 640 of the antenna structure in a low band (LB) 610 and in a high band (HB) 620. The total system efficiency parameter 640 is measured in decibels (dB). The graph 600 further shows a reflection coefficient of the antenna structure when using component matching network.

Figure 7:
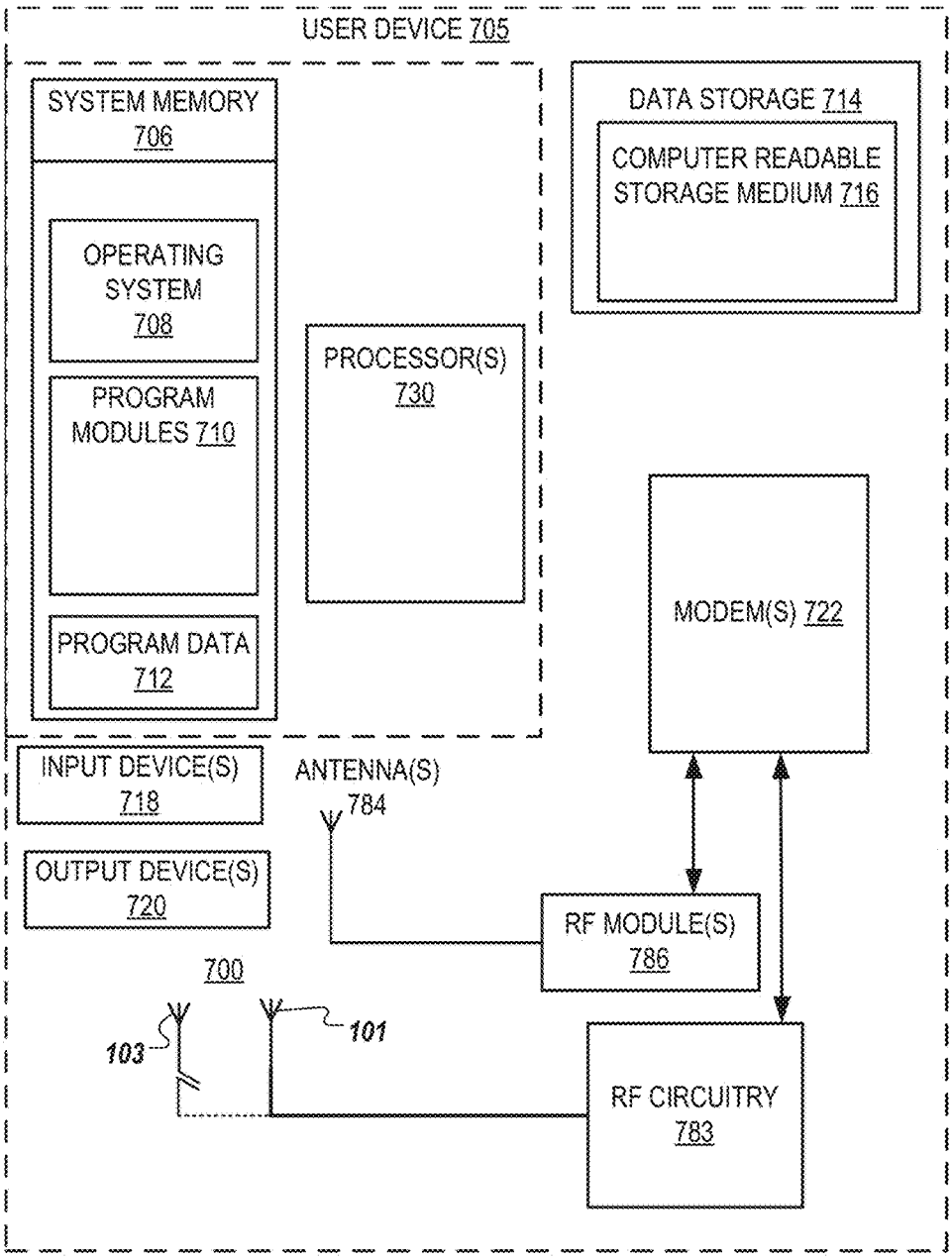
FIG. 7 is a block diagram of an electronic device in which embodiments of a radio device with an antenna structure may be implemented.

FIG. 7 is a block diagram of an electronic device 705 in which embodiments of an antenna structure 700 with a low-band structure 101 and a high-band structure 103 may be implemented. The electronic device 705 may correspond to the electronic device 100 of FIG. 1A. The electronic device 705 may be any type of computing device such as an electronic book reader, a PDA, a mobile phone, a laptop computer, a portable media player, a tablet computer, a camera, a video camera, a netbook, a desktop computer, a gaming console, a DVD player, a Blu-ray®, a computing pad, a media center, a voice-based personal data assistant, and the like. The electronic device 705 may be any portable or stationary electronic device. For example, the electronic device 705 may be an intelligent voice control and speaker system. Alternatively, the electronic device 705 can be any other device used in a WLAN network (e.g., Wi-Fi® network), a WAN network, or the like.

The electronic device 705 includes one or more processor(s) 730, such as one or more CPUs, microcontrollers, field programmable gate arrays, or other types of processors. The electronic device 705 also includes system memory 706, which may correspond to any combination of volatile and/or non-volatile storage mechanisms. The system memory 706 stores information that provides operating system component 708, various program modules 710, program data 712, and/or other components. In one embodiment, the system memory 706 stores instructions of the methods as described herein. The electronic device 705 performs functions by using the processor(s) 730 to execute instructions provided by the system memory 706.

The electronic device 705 also includes a data storage device 714 that may be composed of one or more types of removable storage and/or one or more types of non-removable storage. The data storage device 714 includes a computer-readable storage medium 716 on which is stored one or more sets of instructions embodying any of the methodologies or functions described herein. Instructions for the program modules 710 may reside, completely or at least partially, within the computer-readable storage medium 716, system memory 706 and/or within the processor(s) 730 during execution thereof by the electronic device 705, the system memory 706 and the processor(s) 730 also constituting computer-readable media. The electronic device 705 may also include one or more input devices 718 (keyboard, mouse device, specialized selection keys, etc.) and one or more output devices 720 (displays, printers, audio output mechanisms, etc.).

The electronic device 705 further includes a modem 722 to allow the electronic device 705 to communicate via a wireless network (e.g., such as provided by the wireless communication system) with other computing devices, such as remote computers, an item providing system, and so forth. The modem 722 can be connected to RF circuitry 783 and zero or more RF modules 786. The RF circuitry 783 may be a WLAN module, a WAN module, PAN module, or the like. Antennas 788 are coupled to the RF circuitry 783, which is coupled to the modem 722. Zero or more antennas 784 can be coupled to one or more RF modules 786, which are also connected to the modem 722. The zero or more antennas 784 may be GPS antennas, NFC antennas, other WAN antennas, WLAN or PAN antennas, or the like. The modem 722 allows the electronic device 705 to handle both voice and non-voice communications (such as communications for text messages, multimedia messages, media downloads, web browsing, etc.) with a wireless communication system. The modem 722 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 722 may generate signals and send these signals to antenna 788 and 784 via RF circuitry 783 and RF module(s) 786 as described herein. Electronic device 705 may additionally include a WLAN module, a GPS receiver, a PAN transceiver and/or other RF modules. These RF modules may additionally or alternatively be connected to one or more of antennas 784, 788. Antennas 784, 788 may be configured to transmit in different frequency bands and/or using different wireless communication protocols. The antennas 784, 788 may be directional, omnidirectional, or non-directional antennas. In addition to sending data, antennas 784, 788 may also receive data, which is sent to appropriate RF modules connected to the antennas.

In one embodiment, the electronic device 705 establishes a first connection using a first wireless communication protocol, and a second connection using a different wireless communication protocol. The first wireless connection and second wireless connection may be active concurrently, for example, if an electronic device is downloading a media item from a server (e.g., via the first connection) and transferring a file to another electronic device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 722 is shown to control transmission and reception via antenna (784, 788), the electronic device 705 may alternatively include multiple modems, each of which is configured to transmit/receive data via a different antenna and/or wireless transmission protocol.

The electronic device 705 delivers and/or receives items, upgrades, and/or other information via the network. For example, the electronic device 705 may download or receive items from an item providing system. The item providing system receives various requests, instructions and other data from the electronic device 705 via the network. The item providing system may include one or more machines (e.g., one or more server computer systems, routers, gateways, etc.) that have processing and storage capabilities to provide the above functionality. Communication between the item providing system and the electronic device 705 may be enabled via any communication infrastructure. One example of such an infrastructure includes a combination of a wide area network (WAN) and wireless infrastructure, which allows a user to use the electronic device 705 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by products using the Wi-Fi® technology based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the electronic device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The electronic devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The electronic devices 705 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "ally inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

radio frequency (RF) circuitry comprising an RF feed;

a metal cover comprising a first strip element, a second strip element, a first corner ground element, and a second corner ground element are each disposed at a periphery of the metal cover, wherein:

the first strip element is physically separated from the first corner ground element by a first cutout in the metal cover, the second strip element is physically separated from the first strip element by a second cutout in the metal cover, and the second corner ground element is physically separated from the second strip element by a third cutout in the metal cover, wherein the first corner ground element and the second corner ground element extend from a ground plane;

an antenna structure coupled to the RF feed with a feed line, the antenna structure comprising the ground plane, a feed point, the first strip element, the second strip element, the first corner ground element, and the second corner ground element, wherein:

the first strip element is coupled to the feed line at the feed point located at a first side of the first strip element;

the first strip element is coupled to the first corner ground element at a first end and is coupled to the second strip element at a second end; and the second strip element is coupled to the second corner ground element.

2. The electronic device of claim 1, further comprising:

a first capacitor disposed between the first corner ground element and the first strip element at the first end of the first strip element;

a second capacitor disposed between the first strip element and the second strip element; and a printed circuit board disposed between the second strip element and the second ground element, wherein the printed circuit board comprises:

a conductive path between a first connection coupled to the second strip element and a second connection coupled to the second corner ground element; and a lumped capacitor and a lumped inductor disposed along the conductive path.

3. The electronic device of claim 2, wherein the antenna structure further comprises:

a first antenna formed by:

the first corner ground element coupled to the first strip element by the first capacitor, the first strip element coupled to the second strip element by the second capacitor, and the second strip element coupled to the second corner ground element by the printed circuit board; and a second antenna formed by the first corner ground element coupled to the first corner ground element by the first capacitor.

4. The electronic device of claim 1, wherein the RF circuitry comprises a wireless area network (WAN) module, wherein the WAN module is operable to:

cause the first corner ground element and the first strip element to radiate electromagnetic energy in a first frequency range in a first resonant mode; and cause the first corner ground element, the first strip element, the second strip element, and the second corner ground element together to radiate electromagnetic energy in a second frequency range in a second resonant mode.

5. An apparatus comprising:

a metal cover comprising:

a first corner ground element;

a second corner ground element;

a first strip element, wherein:

the first strip element is physically separated from the first corner ground element by a first cutout in the metal cover, the first strip element is:

physically separated from a second strip element by a second cutout in the metal cover, coupled to the first corner ground element at a first end, and coupled to the second strip element at a second end;

the second strip element is:

physically separated from the second corner ground element by a third cutout in the metal cover, and coupled to the second corner ground element;

a radio frequency (RF) feed coupled with a feed line to the first strip element; and a RF circuitry coupled to the RF feed, wherein the RF circuitry is operable to cause the first corner ground element and the first strip element to radiate electromagnetic energy in a first frequency range.

6. The apparatus of claim 5, wherein the radio frequency (RF) feed is coupled to the first strip element at a feed point, the feed point is to:

receive a first signal to cause the first corner ground element and the first strip element to radiate electromagnetic energy in the first frequency range; and receive a second signal to cause the first corner ground element, the first strip element, the second strip element, and the second corner ground element, and the metal cover to radiate electromagnetic energy in a second frequency range.

7. The apparatus of claim 5, further comprising:

a matching circuitry disposed in-line with the RF feed and the first strip element; and proximity sensing circuitry coupled to the second strip element, wherein the proximity sensing circuitry is operable to measure a capacitance of the second strip element.

8. The apparatus of claim 5, wherein the RF circuitry is operable to cause the first corner ground element, the first strip element, the second strip element, and the second corner ground element to radiate electromagnetic energy in a second frequency range, the second frequency range being lower than the first frequency range.

9. The apparatus of claim 5, wherein the RF circuitry is operable to apply a signal at a feed point, wherein:

the signal causes a first current flow along the feed point towards the first strip element, and the signal causes a second current flow along the first strip element and the second strip element in a same direction as the first current flow.

10. The apparatus of claim 5, wherein the first cutout, the second cutout, and the third cutout are disposed at symmetric locations on a first side of the apparatus relative to a center point on the first side.

11. The apparatus of claim 5, further comprising a proximity sensing circuitry coupled to the second strip element, wherein:

the proximity sensing circuitry is operable to measure a capacitance of the first strip element and the second strip element in a first mode, and the first strip element and the second strip element are operable to radiate the electromagnetic energy in a second mode.

12. The apparatus of claim 5, further comprising:

a first capacitor disposed between the first corner ground element and the first strip element at the first end of the first strip element;

a second capacitor disposed between the first strip element and the second strip element at the second end of the first strip element; and a printed circuit board disposed between the second strip element and the second ground element, wherein the printed circuit board comprises:

a conductive path between a first connection coupled to the second strip element and a second connection coupled to the second corner ground element; and a lumped capacitor and a lumped inductor disposed along the conductive path.

13. The apparatus of claim 5, wherein the first corner ground element is an L-shape that starts at a first side of the metal cover and bends to a second side, and wherein the first side and the second side of the metal cover are curved.

14. The apparatus of claim 5, wherein the RF circuitry comprises a wireless area network (WAN) module, wherein the WAN module is operable to:

cause the first corner ground element and the first strip element to radiate electromagnetic energy in the first frequency range in a first resonant mode; and cause the first corner ground element, the first strip element, the second strip element, and the second corner ground element together to radiate electromagnetic energy in a second frequency range in a second resonant mode.

15. The apparatus of claim 14, wherein:

the first frequency range is between approximately 770 MHz and approximately 1.0 GHz, and the second frequency range is between approximately 1.7 GHz and 2.2 GHz.

16. An antenna structure comprising:

a metal cover;

a feed point coupled to a first strip element, wherein the feed point is to receive a signal to cause the antenna structure to radiate electromagnetic energy;

a first corner ground element;

a second corner ground element;

the first strip element coupled to a radio frequency (RF) feed with a feed line at the feed point located at a first side of the first strip element, and the first corner ground element is separated from the first strip element by a first cutout in the metal cover, wherein:

a first end of the first strip element is coupled to the first corner ground element, and a second end of the first strip element is coupled to a first end of a second strip element; and the second strip element, wherein:

the second strip element physically separated from the first strip element by a second cutout in the metal cover, the second strip element is physically separated from the second corner ground element by a third cutout in the metal cover, and a second end of the second strip element is coupled to the second corner ground element.

17. The antenna structure of claim 16, wherein the feed point is to:

receive a first signal to cause the first corner ground element and the first strip element to radiate electromagnetic energy in a first frequency range; and receive a second signal to cause the first corner ground element, the first strip element, the second strip element, and the second corner ground element, and the metal cover to radiate electromagnetic energy in a second frequency range.

18. The antenna structure of claim 17, further comprising:

a first capacitor disposed between the first corner ground element and the first strip element at the first end of the first strip element;

a second capacitor disposed between the first strip element and the second strip element at the second end of the first strip element; and a printed circuit board disposed between the second strip element and the second ground element, wherein:

the printed circuit board comprises:

a conductive path between a first connection coupled to the second strip element and a second connection coupled to the second corner ground element;

a lumped capacitor and a lumped inductor disposed on the conductive path;

the first signal causes, by the first capacitor, a first current flow along the first strip element; and the second signal causes, by the second capacitor and the printed circuit board, a second current flow along the first strip element and the second strip element.

19. The antenna structure of claim 17, wherein:

the first frequency range is between approximately 770 MHz and approximately 1.0 GHz, and the second frequency range is between approximately 1.7 GHz and 2.2 GHz.

20. The antenna structure of claim 16, wherein:

the first corner ground element and the first strip element are operable to radiate electromagnetic energy in a first frequency range; and the first corner ground element, the first strip element, the second strip element, and the second corner ground element are operable to radiate electromagnetic energy in a second frequency range, the second frequency range being lower than the first frequency range.

* * * * *